US007013696B2

(12) United States Patent
Ando et al.

(10) Patent No.: US 7,013,696 B2
(45) Date of Patent: Mar. 21, 2006

(54) METHOD OF MAKING A FLANGED TUBULAR METALLIC PART

(75) Inventors: Minoru Ando, Nagoya (JP); Shigahisa Saida, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 357 days.

(21) Appl. No.: 10/419,154

(22) Filed: Apr. 21, 2003

(65) Prior Publication Data

US 2003/0196468 A1 Oct. 23, 2003

(30) Foreign Application Priority Data

Apr. 19, 2002 (JP) ..... 2002-118246

(51) Int. Cl.
*B21K 21/08* (2006.01)

(52) U.S. Cl. ..... 72/355.6; 356/359

(58) Field of Classification Search ..... 72/354.6, 72/354.8, 355.2, 355.8, 356, 359, 355.6
See application file for complete search history.

(56) References Cited

U.S. PATENT DOCUMENTS 2,748,932 A * 6/1956 Kaul ..... 72/256
3,186,209 A * 6/1965 Friedman ..... 72/334
6,357,274 B1 * 3/2002 Tanaka et al. ..... 72/356

FOREIGN PATENT DOCUMENTS

| | | | | |
|---|---|---|---|---|
| CA | 645083 | * | 7/1962 | ..... 72/354.6 |
| JP | 4-200833 | * | 7/1992 | ..... 72/354.8 |
| JP | 8-52530 | | 2/1996 | |
| JP | 2002-011543 | | 1/2002 | |

* cited by examiner

*Primary Examiner*—Lowell A. Larson
(74) *Attorney, Agent, or Firm*—Sughrue Mion, PLLC

(57) ABSTRACT

A method of making a flanged tubular metallic part by cold forging is provided. The method comprises a step of forming an axial depression in a blank and a flange forming step of making the depression axially deeper while causing a metal of the blank to flow radially outward thereby forming the blank into an intermediate product having a flange. The flange forming step includes axially moving an inner punch of a die assembly so as to cause a leading end of the inner punch to be positioned more forward than a backward side surface of the flange thereby causing the intermediate product to be formed with a sleeve portion that is position backward of the flange while allowing an outer punch of the die assembly to apply a biasing force to a backward side surface of the flange during formation of the flange.

18 Claims, 6 Drawing Sheets

20
21
22
23
24
25
26
27
28
29

10
1
2
2a
2b
3
4
5
6
7
8a
8b
9
12
14
16
18

1
3
4
5
6
(6a)
8a
7
8b
9

50
52
55
51
35
56
38
32
59
33
54
58
39
31
53
41
34
49
44
45
46
36
42
45a
48
40
30
43

60
63
39
31
35
38
33
66
69b
62b
62c
62a
61
65a
69a
65
65b
64
68
69
72a
76
76a
cv
70
72
74

METHOD OF MAKING A FLANGED TUBULAR METALLIC PART

BACKGROUND OF THE INVENTION

The present invention relates to a method of making a flanged tubular metallic part that is used, for example, as a housing of a gas sensor, by cold forging.

For optimizing the combustion efficiency of a combustor such as an automotive engine and boiler, it has been used a gas sensor for detecting the components such as oxygen contained in the exhaust gas emitted from the engine. Such a gas sensor includes a sensor element and a flanged tubular metallic part (i.e., housing) surrounding the sensor element. Such a metallic part is made of ferrite-system stainless steel and shaped so as to be entirely hollow cylindrical and include a hollow portion extending axially therethrough and an integral, outward hexagonal flange.

It is proposed to make such a flanged tubular metallic part by a cold forging process as shown in FIGS. 6A to 6D. As shown in FIG. 6A, a metallic blank 120 of stainless steel, having a cylindrical shape is prepared and is previously annealed and processed by lubrication treatment.

First, by using, though now shown a die assembly having a die, a double-acting punch and a counter punch, a tubular portion 125 having a deep axial hole 124 extending from an end surface 121 of the blank 120 and a hexagonal flange (bolt head) 126 extending outward from an outer circumferential surface 123 are formed at the same time as shown in FIG. 6B.

Then, by using, though not shown, another die assembly having a die, a punch and a counter punch, a deep hole 127 that is made deeper in the tubular portion 125 and a shallow hole 128 having an open end at the other end surface 122 are formed.

Finally, by perforating a wall between the deep hole 127 and the shallow hole 128 by means of a punch (not shown), a hollow portion 129 extending throughout between the end surfaces 121, 122 as shown in FIG. 6D is formed. Thus, a flanged tubular metallic part 130 is obtained (refer to Japanese patent provisional publication No. 8-52530).

SUMMARY OF THE INVENTION

However, as shown in FIG. 6B, there may occur such a case in which a defective circumferential opening or crack k is formed when the deep hole 124 and the flange 126 are formed at the same time. Such a crack k may cause a problem that breakage of the product at the subsequent steps or even if the tubular metallic part 130 is finally formed, it cannot have a required strength. Such a problem occurs when the deep hole 124 is formed for causing the metal of the blank to flow plastically and fill a cavity in the die assembly for forming the flange 126.

That is, there is a difficulty in filling the corner portion of the cavity in the die assembly for forming the flange 126 so that a space or gap Is liable to be formed at the corner portion. Further, such a defective opening or crack k is formed at the inner circumferential corner portion of the deep hole 124 that corresponds in axial position to the backward side surface of the flange 126 (i.e., the side surface closer to the end surface 121). This is because when the deep hole 124 is made deeper by the die assembly so as to have a bottom that is positioned more forward than the backward side surface of the flange 126, the metal is caused to flow both into the above-described cavity and into a space for forming the tubular portion 125 at the same time.

It is accordingly an object of the present invention to provide a method of making a flanged tubular metallic part that is free from the above-described problem and that can make the flanged tubular metallic part by cold forging without causing a crack or the like defective opening, assuredly.

To accomplish the above object, there is provided according to an aspect of the present invention a method of making a flanged tubular metallic part by cold forging comprising a depression forming step of forming an axial depression that is concentric and cylindrical, in a cylindrical blank of ferrite-system stainless steel, and a flange forming step of making the depression axially deeper while causing a metal of the blank to flow radially outward thereby forming the blank into an intermediate product having an annular flange on an outer circumferential surface thereof, wherein the flange forming step is executed by using a flange forming die assembly including an inner punch, an annular outer punch disposed concentrically around the inner punch so as to provide a predetermined space therebetween, a die having a cylindrical hole surrounding the outer punch and a counter punch unit disposed opposite to the inner punch and cooperating with the outer punch and the die so as to define a cavity for forming the flange, and wherein assuming that the direction in which the inner punch is moved for subjecting the blank to the flange forming step is referred to as forward, the flange forming step includes axially moving the inner punch so as to allow a leading end of the inner punch to be position more forward than a backward side surface of the flange thereby causing the intermediate product to be formed with a concentric sleeve portion that is of a predetermined axial length and that is positioned backward of the flange while allowing the outer punch to apply an axial biasing force to the backward side surface of the flange during formation of the flange within the cavity.

There is provided according to another aspect of the present invention a method of making a flanged tubular metallic part by cold forging, comprising a step of preparing a cylindrical blank, a step of heating the blank to a predetermined temperature, a depression forming step of forming an axial depression that is concentric and cylindrical, in the blank, a step of preparing a flange forming die assembly including an inner punch, an annular outer punch disposed concentrically around the inner punch so as to provide a predetermined space therebetween, a die having a cylindrical hole surrounding the outer punch and a counter punch unit disposed opposite to the inner punch and cooperating with the outer punch and the die so as to define an annular cavity for forming an annular flange, and a flange forming step of forming, by using the flange forming die assembly, the blank into an intermediate product having the flange on an outer circumferential surface thereof, wherein assuming that the direction in which the inner punch is moved for subjecting the blank to the flange forming step is referred to as forward, the flange forming step Includes moving the inner punch axially into the depression so as to allow a leading end of the inner punch to be positioned more forward than a backward side surface of the flange thereby causing a metal of the blank to flow radially outward into the cavity to form the flange and axially backward to form, in the space between the inner punch and the outer punch and by backward extrusion, a concentric sleeve portion that is positioned backward of the flange while allowing the outer punch to be yieldingly urged against the backward side surface of the flange during formation of the flange within the cavity.

DESCRIPTION OF THE PREFERRED EMBODIMENT

Figures 1A, 1B, 1C:
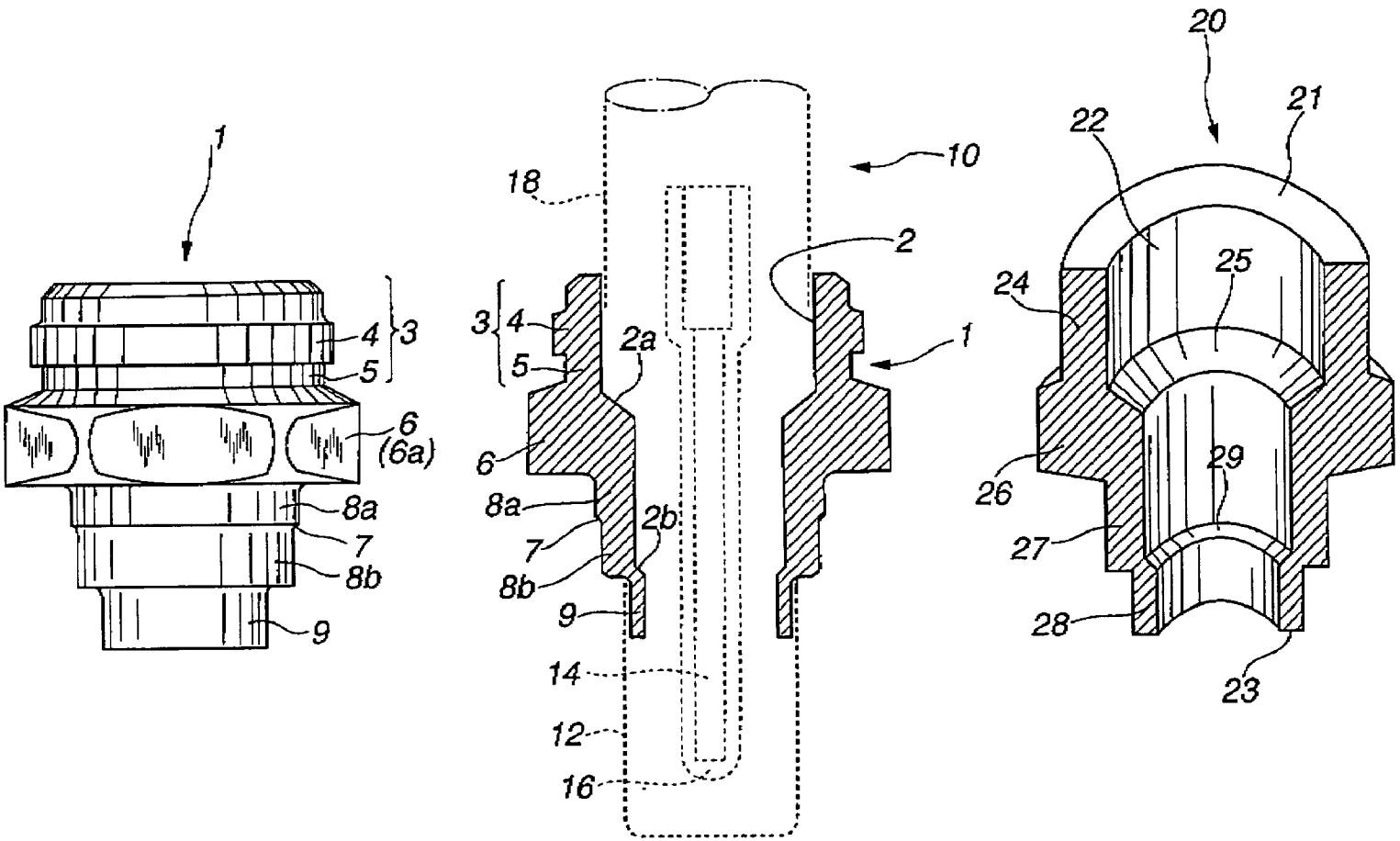
FIG. 1A is a side elevational view of a housing for use in a gas sensor.
FIG. 1B is a sectional view of the housing of FIG. 1A together with other constituent parts of the gas sensor.
FIG. 1C is a perspective section of a flanged tubular metallic part that is made by a method of the present invention and that is in the state of being immediately before finished into the housing of FIGS. 1A and 1B.

Referring first to FIGS. 1A and 1B, a housing for use in an automotive gas or oxygen sensor is generally indicated by 1.

The housing 1 includes a basic end portion 3 having a larger diameter section 4 and a smaller diameter section 5, a flange 6 located next to the basic end portion 3 and having such a polygonal shape that is similar to a bolt head or nut when observed in a plan view, sleeve portions 8*a*, 8*b* located next to the flange 6 and interposing therebetween a shoulder portion 7, a leading end portion 9 located next to the sleeve portions 8*a*, 8*b* and a hollow portion 2 extending axially through the housing 1. Such a hollow portion 2 is stepped to have shoulder portions 2*a*, 2*b* so as to become smaller in diameter as it extends nearer to the leading end portion 9.

As shown in FIG. 1B, the oxygen sensor 10 has a heater 14 and a detecting element 16 inside the housing 1, and has a perforated protective cap 12 attached to the leading end portion 9 and a metal casing 18 secured at a leading end to the basic end portion 3.

The oxygen sensor 10 is installed on an exhaust pipe (not shown) of an automotive vehicle by way of the housing 1 so as to allow a leading end of the detecting element 16 protected by the protective cap 12 to protrude into the exhaust pipe and be exposed to the exhaust gas. The oxygen sensor 10 detects oxygen that is a detected gas component contained in the exhaust gas for controlling the combustion efficiency of the engine optimally in response to a variation in detection of oxygen.

FIG. 1C shows a flanged tubular metallic part 20 in the state of being immediately before finished into the housing 1. Such a metallic part 20 is made of stainless steel that will be described later and generally shaped so as to be nearly hollow cylindrical and include a thick-walled basic cylindrical portion 24 having a basic end surface 21, a flange 26 located next to the basic cylindrical portion 24 and having a hexagonal shape when observed in a plan view and an intermediate sleeve portion 27 and a leading end sleeve portion 28 so as to constitute an integral unit. A hollow portion 22 extends between the basic end surface 21 and a leading end surface 23 so as to become smaller in diameter stepwise by means of the shoulder portions 25, 28 as it goes nearer to the leading end sleeve portion 28. Such a flanged tubular metallic part 20 is formed from a cylindrical metal blank 30 that will be described later, by cold forging that is a process constituting the method of the present invention. Further, the metallic part 20 is finished by cutting, etc. and thereby formed into the housing 1.

Hereinafter, the method of making the flanged tubular metallic part 20 according to the present invention will be described.

Figures 2A, 2B, 2C, 2D:
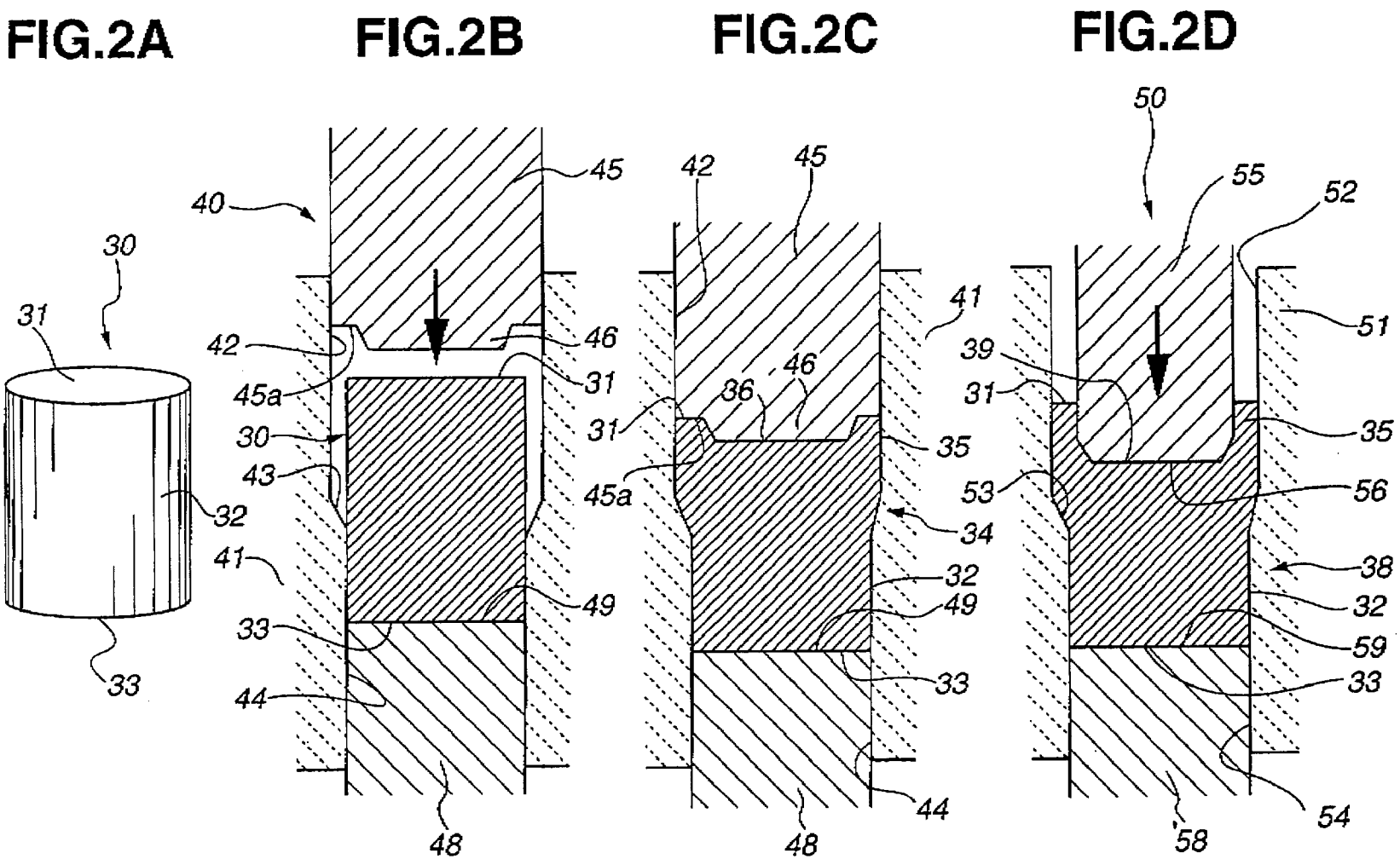
FIG. 2A is a perspective view of a blank used in a method of making a flanged tubular metallic part according to the present invention.
FIGS. 2B to 2D are schematic views for illustration of a depression forming step in the method of the present invention.

FIG. 2A shows a metallic blank 30 used in the method of the present invention. The blank 30 is generally cylindrical as shown and has a circumferential surface 32 and a pair of opposite end surfaces 31, 33. The blank 30 is for example obtained by cutting a rod of ferrite-system stainless steel such as SUS430 (Fe-18 wt % Cr) and SUS434 (Fe-18 wt % Cr-1 wt % Mo) according to JIS G4303, that has a good resistance to corrosion, to a predetermined length.

The blank 30 is previously heated at the temperature ranging from 50° C. to 60° C. by means of, for example, an induction heating device (not shown) and thereafter immediately transferred to a first cold forging station 40 (refer to FIGS. 2B to 2C) that will be described later.

First, at the first cold forging station 40 shown in FIGS. 2B to 2C, the blank 30 is subjected to a first depression forming step, i.e., an end surface 31 of the blank 30 is formed with a truncated conical depression 36.

The first cold forging station 40 is provided with a die assembly that includes a die 41 a punch 45 and a counter punch 48. The die 41 has a larger-diameter cylindrical hole 42, a tapered hole 43 and a slightly smaller-diameter cylindrical hole 44 that are arranged concentrically so as to constitute a through hole. Into the cylindrical hole 42 is insertable a punch 45 of nearly the same diameter, and in the cylindrical hole 44 is axially movably disposed the counter punch 48. The inner diameter of the cylindrical hole 44 is nearly equal to that of the metallic blank 30. In the meantime, the die 41, punch 45 and counter punch 48 are formed from tool steel.

After the blank 30 is heated and processed by lubrication treatment, it is inserted into the cylindrical holes 42, 44 of the die 41 and placed on a leading end surface 49 of the counter punch 48. Under such a condition, the punch 45 is moved forward into the cylindrical hole 42 of the die 41 as indicated by the arrow in FIG. 2B.

As a result, as shown in FIG. 2C, the blank 30 is formed into a worked blank 34, that is, an end surface 45*a* of the punch 45 is pressed against the end surface 31 of the blank 30 and causes a truncated conical protruded portion 46 at the center of the end surface 45*a* to cut Into the end surface 31. As a result, the worked blank 34 is formed with a truncated conical depression 36 at the center of the end surface 31. The depression 36 serves as a guide hole for guiding a punch used in the subsequent process steps. At the same time, the cut mark at the end surface 31 of the blank 30 is flattened.

Further, the blank 30 is increased in diameter at the end surface 31 side thereof by upsetting and formed with a larger-diameter portion 35 after the shape of the cylindrical hole 42. The end surface 33 of the blank 30 is abuttingly engaged with an end surface 49 of the counter punch 48 so that the cut mark at the end surface 33 is flattened.

The worked blank 34 thus has the truncated conical depression 36 at the central portion of the end surface 31. Thereafter, the punch 45 is raised (moved backward) and the counter punch 48 is raised (moved forward), whereby the blank 34 can be removed from the die 41.

Then, the blank 34 is transferred to a second cold forging station 50 shown in FIG. 2D and subjected to a second depression forming step for making the depression 36 deeper.

The second cold forging station 50 is provided with a die assembly that includes a die 51, a punch 55 and a counter punch 58. The die 51 has a larger-diameter cylindrical hole 52, a tapered hole 53 and a slightly smaller-diameter cylindrical hole 54 that are arranged concentrically to constitute a through hole. Into the cylindrical hole 52 is insertable a punch 55 that is smaller in diameter than the cylindrical hole 52. In the cylindrical hole 54 is axially movably disposed the counter punch 58 that Is nearly equal in diameter to the cylindrical hole 54.

The inner diameter of the larger-diameter cylindrical hole 52 of the die 51 is nearly equal to the outer diameter of the larger-diameter portion 35 of the metallic blank 34 in the middle of forming, and the inner diameter of the smaller-diameter cylindrical hole 54 is nearly equal to the outer diameter of an end surface 33 side portion of the blank 34. Further, a truncated conical end surface 56 of the punch 55 corresponds in shape to the protruded portion 46 of the punch 45.

As shown in FIG. 2D, the worked blank 34 obtained by the step of FIGS. 2B and 2C is inserted into the cylindrical holes 52, 54 of the die 51 to allow the end surface 33 to be placed on a leading end surface 59 of the counter punch 58. At this time, the larger-diameter portion 35 of the blank 34 is set in the cylindrical hole 52 of the die 51 without any gap therebetween. Under this condition, the punch 55 is moved forward into the cylindrical hole 52 as indicated by the arrow in FIG. 2D.

As a result, at the end surface 31 of the worked blank 38 is formed a little deeper depression 39 that is shaped after the punch 55 and the end surface 56 thereof. In the meantime, the larger-diameter portion 35 of the blank 38 is extruded backward and toward the end surface 31 side so as to become a little longer. Thereafter, the punch 55 is raised (moved backward) and the counter punch 58 is raised (moved forward), whereby the blank 38 can be removed from the die 51. In the meantime, the worked blank 38 can be formed from the original blank 30 at one time by feeding the original blank 30 to the second cold forging station 50, i.e., by subjecting the blank 30 to a single depression forming step.

Figures 3A, 3B, 3C:
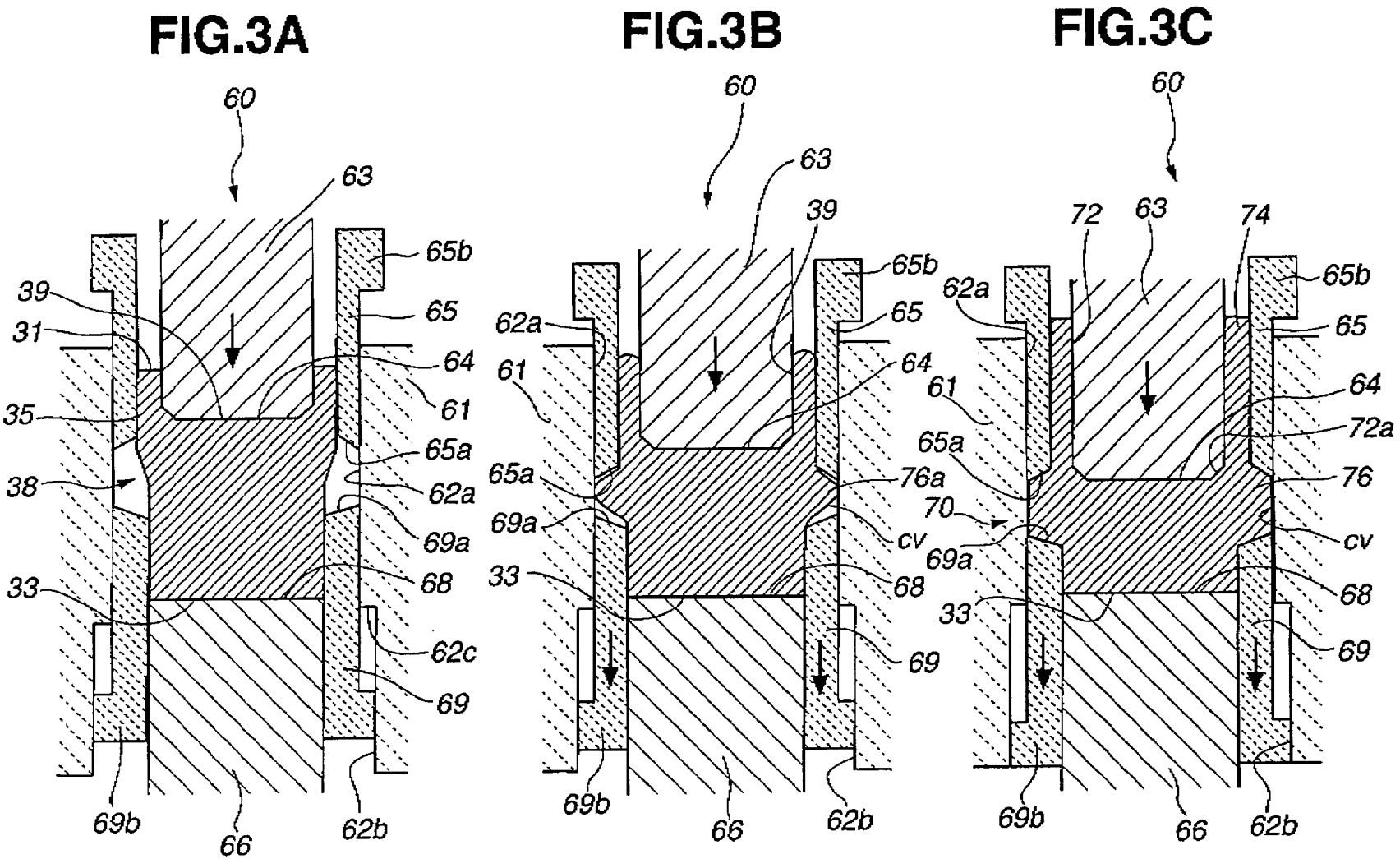
FIGS. 3A to 3C are schematic views for illustration of a flange forming step in the method of the present invention.

Then, the worked blank 38 is transferred to a third cold forging station 60 shown in FIGS. 3A to 3C and subjected a flange forming step of the method of the present invention.

The cold forging station 60 is provided with a flange forming die assembly that includes a die 61, an inner punch 63, an outer punch 65 disposed concentrically outside and axially movably relative to the inner punch 63 with a predetermined space therebetween, an inner counter punch 66, and an outer counter punch 69 disposed concentrically outside the inner counter punch 66 and axially movably within the die 61. The counter punches 66, 69 can be regarded as constituting a counter punch unit. In this step, the direction in which the inner punch 63 is moved for subjecting the blank 38 to the flange forming step is referred to as forward, i.e., the downward direction in FIG. 3A is referred to as forward.

As shown in FIG. 3A, the die 61 has an upper larger-diameter cylindrical hole 62*a*, a lower larger-diameter cylindrical hole 62*b* and a shoulder portion 62*c* that are arranged concentrically with each other. The upper cylindrical hole 62*a* is longer than the lower cylindrical hole 62*b*.

Within the cylindrical holes 62*a*, 62*b* of the die 61 is concentrically disposed the outer counter punch 69 that is hollow cylindrical. The outer counter punch 69 has a leading end surface 69*a* (i.e., backward end surface) that is inclined so that a radially inner surface portion is located more forward and a larger-diameter rear end portion 69*b*. The outer counter punch 69 is supported by or operatively connected to a spring or hydraulic device (not shown) that is disposed at a rear end thereof (i.e. forward end). The leading end surface 69*a* of the outer counter punch 69 moves upward and downward within the cylindrical hole 62*a*, and a rear end portion (i.e., forward end portion) 69*b* of the outer counter punch 69 moves upward and downward within the cylindrical hole 62*b*. Further, inserted into the outer counter punch 69 through the rear end portion 69*b* thereof is the inner counter punch 66 that is axially movable in the outer counter punch 69.

As shown in FIG. 3A, the inner punch 63 is movable into the cylindrical hole 62*a* of the die 61 by means of a raising and lowering device (not shown). The outer diameter of the inner punch 63 is nearly equal that of the above-described punch 55 (refer to FIG. 2D). The outer punch 65 is disposed concentrically around the inner punch 63 so as to provide therebetween a predetermined space. The outer punch 65 is axially movable relative to the inner punch 63 and is supported by or operatively connected to a spring or hydraulic device (not shown) disposed at the rear or backward end thereof. The outer punch 65 has a leading end surface 65*a* that is inclined so that a radially outer surface portion is position more forward and a larger diameter rear or backward end portion 65*b* such that the leading end surface 65*a* is raised and lowered along the inner circumferential surface of the cylindrical hole 62*a*.

For executing the flange forming step, the inner punch 63 and the outer punch 65 are first held above the die 61. Under the condition where the leading end surface 69*a* of the outer counter punch 69 is positioned within the cylindrical hole 62*a* of the die 61 and more backward than the leading end surface 68 of the inner counter punch 66, the above-described blank 38 that is oriented so as to have the depression 39 on the backward side is inserted into the cylindrical hole 62*a* of the die 61 and placed on the leading end surface 68 of the inner counter punch 66.

In the meantime, the inner diameter of the outer punch 65 is nearly equal to the larger-diameter portion 35 of the worked blank 38.

As shown in FIG. 3A, the outer punch 65 is lowered (moved forward) and moved into the space between the larger-diameter portion 35 of the blank 38 and the cylindrical hole 62*a* of the die 61.

Then, under the condition where the outer punch 65 is lowered or moved more forward than the leading end surface 64 of the inner punch 63 as shown in FIG. 3A, the inner punch 63 and the outer punch 65 are lowered or moved forward nearly in parallel with each other. Then, the leading end surface 65*a* of the outer punch 65 is positioned adjacent the axially middle portion of the blank 38 and held opposed more closely to the leading end surface 69*a* of the outer counter punch 69.

Further, when as indicated by the arrow in FIG. 3B, the leading end surface 64 of the inner punch 63 is pushed into the depression 39 of the blank 38, the blank 38 is pushed toward the end surface 33 side by the inner punch 63 and allows a metal of the blank 38 to flow or protrude radially outward into a ring-shaped cavity cv defined by the cylindrical hole 62*a* of the die 61, the leading end surface 65*a* of the outer punch 65 and the leading end surface 69*a* of the outer counter punch 69 and thereby be formed into a flange 76*a* of a nearly semi-circular cross section.

Subsequently, when as indicated by the arrow in FIG. 3C, the inner punch 63 is moved forward (lowered), the outer counter punch 69 is moved forward (lowered) while applying a biasing force to the front side surface of the flange 76 by means of the spring or hydraulic device. At this time, the outer punch 65 is moved backward while applying a biasing force to the backward side surface of the flange 76 and stopped. On the other hand, the inner punch 63 is held stationary at the position where the leading end surface 64 is positioned more forward than the rear side surface of the flange 76, i.e., more forward than the leading end surface 65*a* of the outer punch 65.

At this time, as shown In FIG. 3C, the inner punch 63 is moved further forward so as to allow the metal of the blank 38 to flow further into the cavity cv without leaving any space or gap at the corner of the cavity cv. This prevents the blank 38 from being formed with a circumferential crack or the like defective opening at the bottom and its adjacent portion of the depression 72, i.e., at the position or level corresponding to the backward side surface of the flange 76. By the flange forming step shown in FIGS. 3A to 3C, the blank 38 is formed into an intermediate product 70 having a sleeve portion 74 that is formed by backward extrusion, the deep depression 72 disposed inside the sleeve portion 74 and having a chamfered corner 72*a* and the annular flange 76.

Thereafter, as shown in FIG. 3C, by raising or moving backward the inner punch 63, the outer punch 65 and the inner counter punch 66, the intermediate product 70 is removed from the die 61.

Figure 4C:
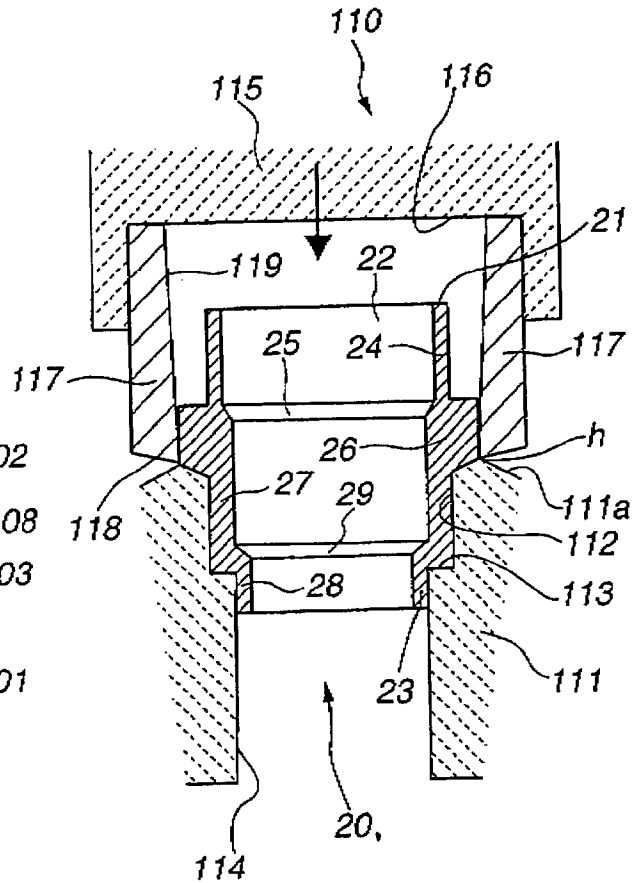
FIG. 4C is a schematic view of a trimming step of the method of the present invention.
Figure 4B:
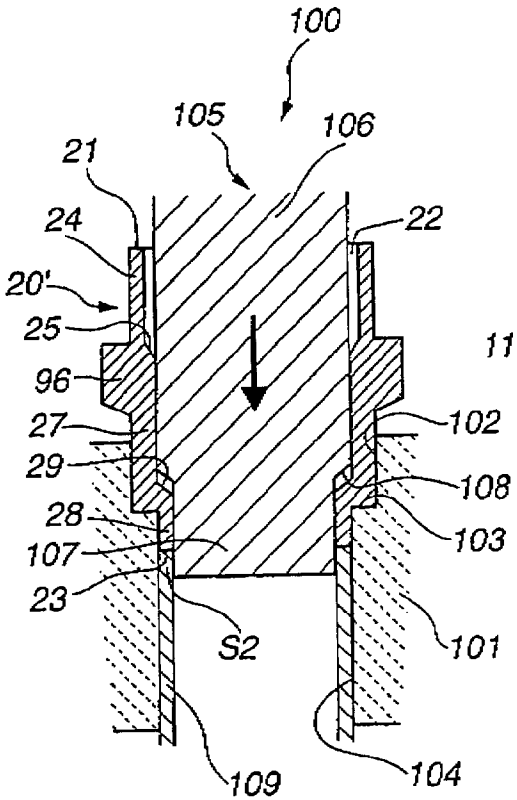
FIG. 4B is a schematic view of a hollow portion forming step of the method of the present invention.
Figure 4A:
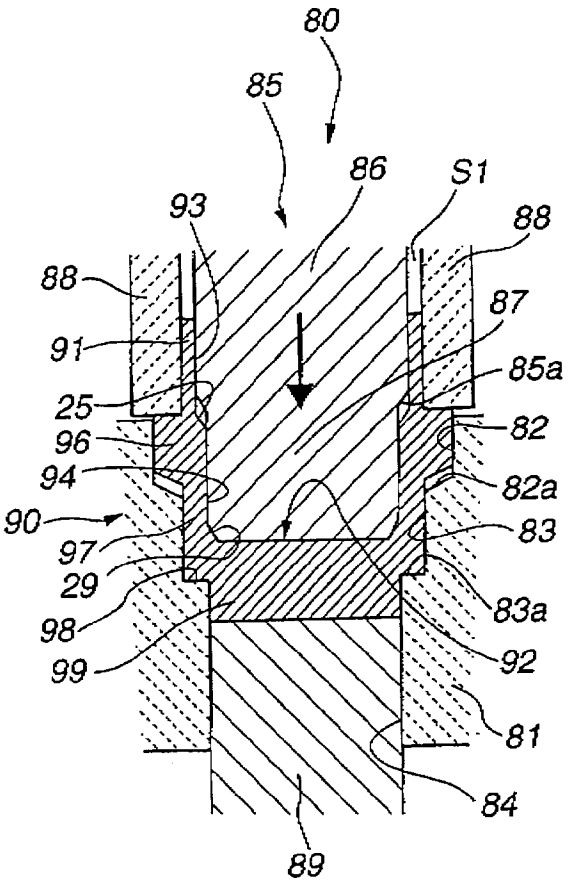
FIG. 4A is a schematic view for illustration of a depression finishing step of the method of the present invention.

FIG. 4A shows d depression finishing step to which the intermediate product 70 is subjected and a fourth cold forging station 80 used for carrying out the depression finishing step. The fourth cold forging station 80 is provided with a die assembly that includes a die 81, an inner punch 85, an outer guide 88 and a counter punch 89.

As shown in FIG. 4A, the die 81 has a concentric, stepped, cylindrical through hole including, in the order from above, a larger-diameter hole section 82, an intermediate-diameter hole section 83 and a smaller-diameter hole section 84. The intermediate-diameter hole section 83 has a diameter intermediate between those of the larger-diameter hole section 82 and the smaller-diameter hole section 84. The inner punch 85 has a larger-diameter basic end portion 86 and a smaller-diameter leading end portion 87 between which is interposed a tapered portion 85*a*. The leading end portion 87 is moved into the larger-diameter hole section 82 and the intermediate-diameter hole section 83 of the die 81. Further, a hollow cylindrical outer guide 88 is disposed concentrically around the inner punch 85 so as to provide a space s1 therebetween and is axially movable relative to the inner punch 85. Further, the counter punch 89 that is cylindrical and equal in diameter to the smaller-diameter hole section 84 is disposed so as to be axially movable within the smaller-diameter hole section 84.

For subjecting the intermediate product 70 to the depressing finishing step, the inner punch 85 and the outer guide 88 are first positioned above the die 81, and the intermediate product 70 is inserted into the larger-diameter hole section 82 and the intermediate-diameter hole section 83. At this time, the above-described end surface 33 of the intermediate product 70 is brought into contact with the shoulder 83*a* between the intermediate-diameter hole section 83 and the smaller-diameter hole section 84. Further, the counter punch 89 is positioned within the smaller-diameter hole section 84 of the die 81 and has a leading end surface that faces the end surface 33 of the intermediate product 70 (refer to FIG. 3C).

Under such a condition, as shown in FIG. 4A, the outer guide 88 is lowered (moved forward) so as to abuttingly engage the leading end surface thereof with the backward side surface of the flange 76 of the intermediate product 70.

Then, the inner punch 85 is lowered or moved forward so as to cause the leading end portion 57 to be pushed into the depression 72. In the meantime, the outer diameter of the basic end portion 86 of the inner punch 85 is nearly equal to the inner diameter of the depression 72 of the intermediate product 70.

Further, the leading end portion 87 of the inner punch 85 is lowered and moved deeply into the intermediate product 70 so as to have a leading end that is positioned immediately or adjacently above the shoulder 83*a* of the die 81. At the same time, the metal of the intermediate product 70 pressed by the inner punch 85 is caused to flow plastically into the smaller-diameter hole section 84 of the die 81 and such flow of the metal is obstructed by the counter punch 89.

As a result, as shown in FIG. 4A, the intermediate product 70 is formed into an intermediate product 90 having a deep depression 92 including a larger-diameter cylindrical hole section 93 and a smaller-diameter cylindrical hole section 94 between which a shoulder 25 is interposed, a basic sleeve portion 91, a flange 96, a front sleeve portion 97, a shoulder 98 and a disc-shaped leading end portion 99. The sleeve portion 91, flange 96 and the shoulder 25 corresponds to the sleeve portion 74, flange 76 and the chamfered corner 72*a* of the intermediate product 70 of FIG. 3C, respectively. The intermediate product 90 has at the bottom of the depression 92 a chamfered corner or inclined shoulder 29. The intermediate product 90 can be removed from the die 81 by raising or moving backward the inner punch 85, the outer guide 88 and the counter punch 89.

FIG. 4B shows a hollow portion forming step to which the intermediate product 90 is subjected and a fifth cold forging station 100 used for carrying out the hollow portion forming step. The fifth cold forging station 100 is provided with a die assembly that includes a die 101, a punch 105 and a counter punch 109.

As shown in FIG. 4B, the die 101 includes an upper larger-diameter cylindrical hole portion 102, a lower smaller-diameter cylindrical hole portion 104 and a shoulder portion 103 interposed between the cylindrical hole portions 102, 104. The punch 105 Includes a larger-diameter basic end portion 106, a slightly smaller-diameter leading end portion 107 and a tapered shoulder portion 108 interposed between the basic end portion 106 and the leading end portion 107. The punch 105 is movable into the larger-diameter cylindrical hole portion 102 and the smaller-diameter cylindrical hole portion 104. The counter punch 109 is axially movable within the cylindrical hole portion 104 and hollow cylindrical so as to allow the leading end portion 107 of the punch 105 to be movable thereinto.

In the meantime, the inner diameter of the larger-diameter cylindrical hole portion 102 of the die 101 is nearly equal to the outer diameter of the front sleeve portion 97 of the intermediate product 90, and the inner diameter of the smaller-diameter cylindrical hole portion 104 of the die 101 is nearly equal to the outer diameter of the leading end portion 99 of the intermediate product 90.

For subjecting the intermediate product 90 to the hollow portion forming step, the punch 105 is positioned above the die 101, and the front sleeve portion 97 and the leading end portion 99 of the intermediate product 90 are disposed in the larger-diameter cylindrical hole portion 102 and the smaller-diameter cylindrical hole portion 104 of the die 101, respectively. Under this condition, as indicated by the arrow in FIG. 4B, the punch 105 is lowered (moved forward) to abuttingly engage the leading end portion 107 with the leading end portion 99 of the intermediate product 90 and push the same downward. At the same time, the basic end portion 106 of the punch 105 is moved into the depression 92 of the intermediate product 90. As a result, as shown in FIG. 4B, the leading end portion 107 of the punch 105 penetrates the leading end portion 99 of the intermediate product 90 and is partially moved into the counter punch 109. Namely the leading end portion 99 of the intermediate product 90 is perforated by the punch 105.

This causes the leading end portion 99 of the intermediate product 90 to be formed into a thin-walled front sleeve portion 28 that extends downward within a space s2 defined between the smaller-diameter cylindrical hole portion 104 and the leading end portion 107 of the punch 105. Further, there is formed a hollow portion 22 that extends between the end surfaces 21 and 23 and includes the upper and lower shoulder portions 25, 29, Further, the front sleeve portion 97 interposed between the punch 105 and the die 101 constitutes an intermediate sleeve portion 27. As a result, as shown in FIG. 4B, there is obtained a tubular part 20' that is internally formed with the hollow portion 22 and has a basic sleeve portion 24, a flange 96, an intermediate sleeve portion 27 and the front sleeve portion 28. The basic sleeve portion 24, flange 96 and intermediate sleeve portion 27 correspond in shape to the basic sleeve portion 91, flange 96 and front sleeve portion 97 of the intermediate product 90, respectively The tubular part 20' can be removed from the die 101 by elevating or moving backward, in FIG. 4B, the punch 105 and the counter punch 109.

FIG. 4C shows a trimming step to which the tubular part 20' is subjected and a trimming station 110 used for carrying out the trimming step. The trimming station 110 is provided with a trimming die assembly that includes a die 111, a slider 115 and a cutter 117.

As shown in FIG. 4C, the die 111 has a larger-diameter hollow cylindrical portion 112, a smaller-diameter hollow cylindrical portion 114 and a shoulder portion 113 for accommodating therewithin the intermediate sleeve portion 27 and the front sleeve portion 28 of the tubular part 20', and further has a gradually inclined surface portion 111*a* around an upper open end of the larger-diameter hollow cylindrical portion 112. The slider 115 is supported by a raising and lowering device (not shown) so as to be capable of being raised and lowered and has at a bottom surface thereof a recessed portion 116 in which the cutter 117 is fitted and fixedly held. The cutter 117 has a forward end surface 118 that has at a leading end thereof a cutting edge h and is inclined so that a radially inner surface portion is position more forward and a hollow portion 119 that has a hexagonal shape when observed in a plan view and that becomes smaller a little as it goes more toward the cutting edge h.

For subjecting the tubular part 20' to the trimming step, the slider 115 and the cutter 117 are first raised, and the intermediate sleeve portion 27 and the forward sleeve portion 28 of the tubular part 20' are disposed in the larger-diameter hollow cylindrical portion 112 and the smaller-diameter hollow cylindrical portion 114 of the die 111, respectively. At this time, the flange 96 of the tubular part 20' is positioned above the inclined surface 111*a* of the die 111. Under this condition, as shown in FIG. 4C, the slider 115 is lowered (moved forward) so as to allow the leading end surface 118 including the cutting edge h of the cutter 117 to be pushed perpendicularly to the horizontal and onto the outer peripheral portion of the flange 96.

As a result, as shown in FIG. 4C, the outer peripheral portion of the flange 96 is formed into a hexagonal flange 26 when observed in a plan view by being partially cut away or being pressed and is received in a hollow portion 119 of the cutter 117. By this, the flanged tubular metallic part 20 shown in FIG. 1C is obtained.

The above-described method of making the flanged tubular metallic part 20 makes it possible to produce the metallic part 20 that is free from the above-noted circumferential crack or the like defective opening, thus making it possible to attain a high productivity.

In the meantime, the depression finishing step shown in FIG. 4A, the hollow portion forming step shown in FIG. 4B and the trimming step shown in FIG. 4C to which the above-described intermediate product 70 are subjected can be done in the order other than that described above. For example, the trimming step is carried out first and thereafter the depression finishing step and the hollow portion forming step can be done.

Further, transfer of the blanks 30, 34, 38 and the intermediate products 70, 90 and the tubular part 20' between the above-described stations are carried out automatically by using a transfer means or device such as a manipulator (not shown).

Further, between adjacent two of the above-described processes, the intermediate product 70 and so on are not subjected to annealing and a lubricating treatment but the original blank 30 is subjected to the cold forging processes continuously. Accordingly, the above-described metallic part 20 can be produced with efficiency.

Figure 5A:
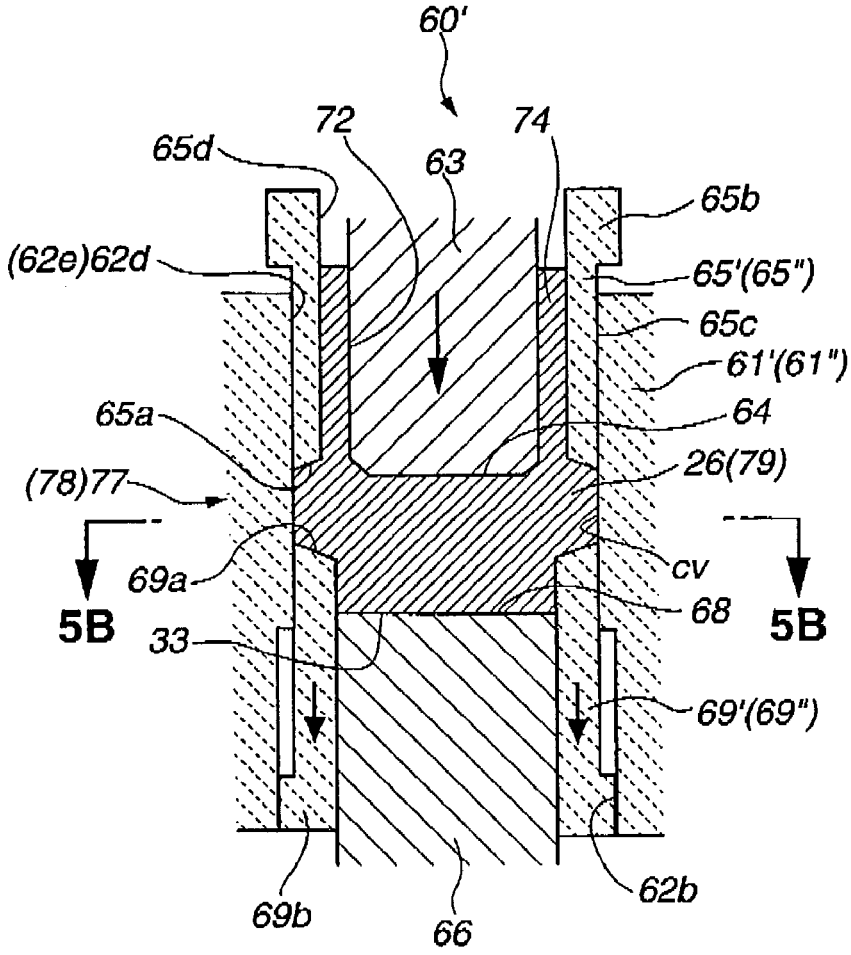
FIG. 5A is a schematic view of a flange forming step according another embodiment of the present invention.
Figure 5B:
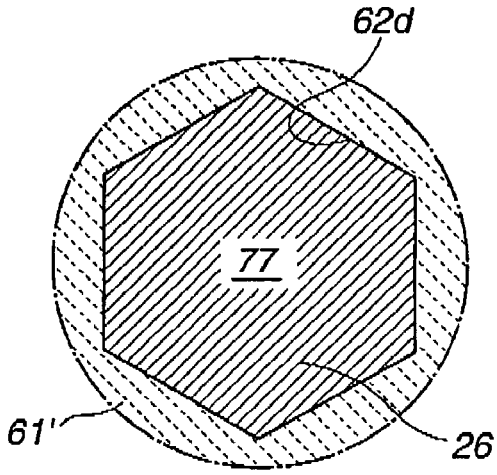
FIG. 5B is a sectional view taken along the line 5B–5B in FIG. 5A.

FIGS. 5A and 5B show a modified flange forming step that is different from the above-described flange forming step and a modified third cold forging station 60' used for carrying out the modified flange forming step.

In the modified third cold forging station 60', the die 61' has a through hole consisting of a smaller hole portion 62*d* that is hexagonal when observed in a plan view as shown in FIGS. 5A and 5B and a larger cylindrical hole portion 62*b*. Further, the outer punch 65' has a hexagonal outer periphery 65*c* and a concentric cylindrical through hole 65*d*. Similarly, the outer counter punch 69' has a hexagonal outer periphery.

Accordingly, when the blank 38 is subjected to a flange forming step similar to that described above by using the third cold forging station 60', an intermediate product 77 having a flange 26 that is hexagonal when observed in a plan view as shown in FIG. 5B is formed. The intermediate product 77 can dispense with the above-described trimming step and therefore can make the productivity of the metallic part 20 further higher.

Figure 5C:
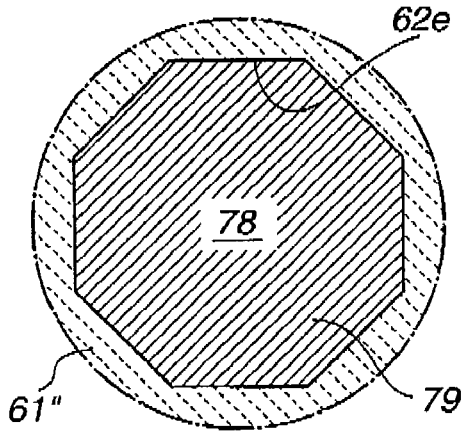
FIG. 5C is a view similar to FIG. 5B but shows a further embodiment of the present invention.
Figures 6A, 6B, 6C, 6D:
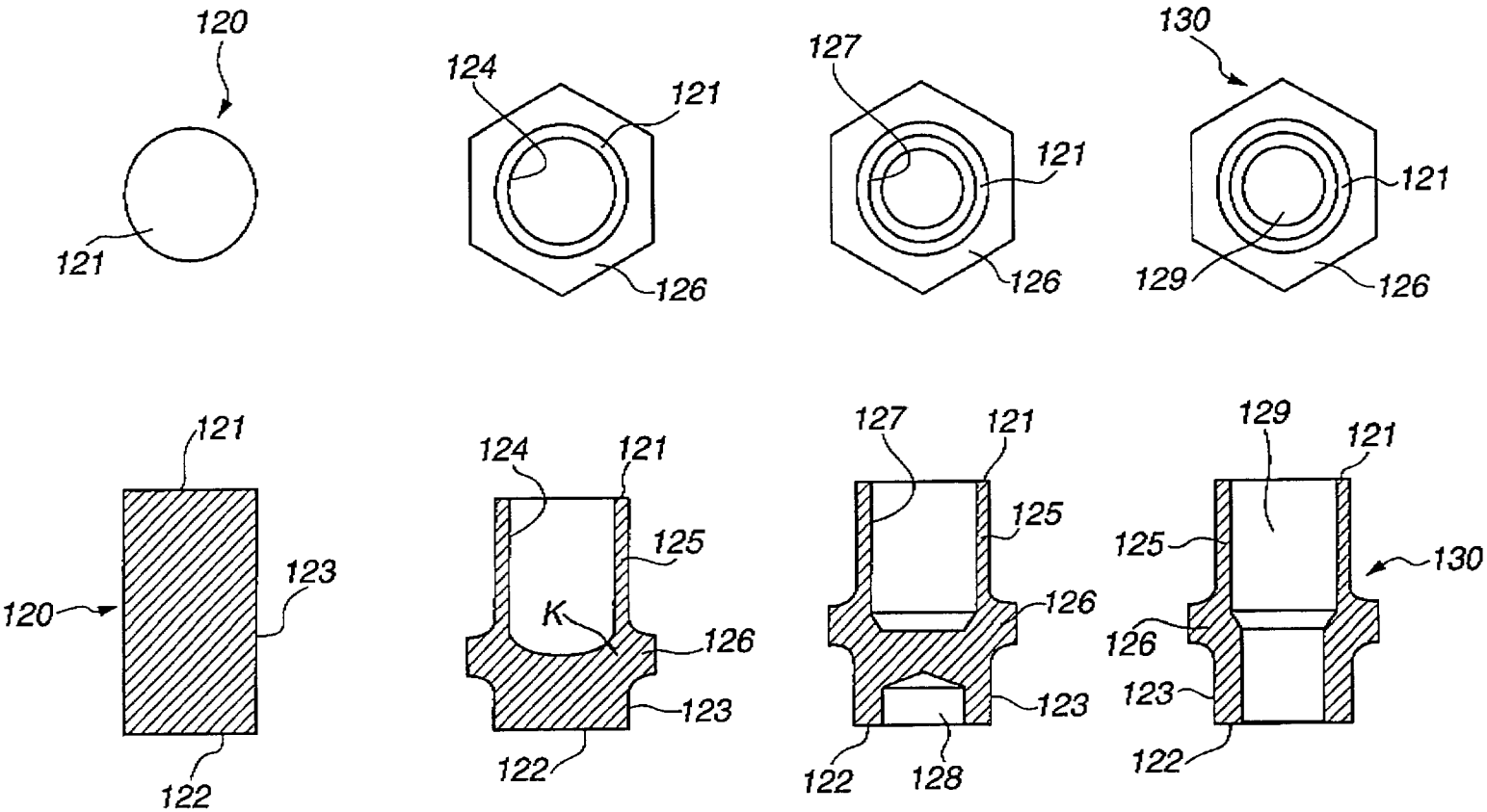
FIG.6A (PRIOR ART)
FIG.6B (PRIOR ART)
FIG.6C (PRIOR ART)
FIG.6D (PRIOR ART)
FIGS. 6A to 6D are schematic views for illustrating a prior art method of making a flanged tubular metallic part.

In the meantime, as shown in FIG. 5C, by using a die 61" having an octagonal smaller hole portion 62*e*, an outer punch 65" with an octagonal outer periphery 65*c* and an outer counter punch 69" with an octagonal outer periphery, an intermediate product 78 having a flange that is octagonal when observed in a plan view can be formed.

In the foregoing, it is to be noted that after the depressed portion 39 (FIG. 2D) is formed in the end surface of the blank 38, it is used as a guide hole of the inner punch 63 (FIG. 3A) and is made deeper by forward movement of the inner punch 63. The forward movement of the inner punch 63 also causes the metal of the blank 38 to plastically flow into the cavity cv that is defined by the die 61, 61' or 61", inner punch 63 and counter punch unit (i.e., the inner counter punch 66 and outer counter punch 69, 69' or 69"). The outer punch 65, 65' or 65" that is urged forward by means of a spring or hydraulic device (not shown) keeps applying a biasing force to the backward side surface of the flange 76, 77 or 78 (refer FIG. 3C or FIG. 5A) during formation of the flange 76, 77 or 78. At the stage where the metal of the blank 38 starts flowing into the cavity cv, the thickness (height) of the cavity cv can be smaller and therefore the volume thereof can be smaller. This enables the metal to flow into the cavity cv with ease and efficiency in response to forward movement of the inner punch 63 so that a vacant space or gap is hardly formed at the corner of the cavity cv. After the metal of the blank 38 fills the cavity cv completely, the outer punch 65, 65' or 65" is caused to move backward so that the flange 76, 77 or 78 is increased in thickness. That is, the thickness of the flange 76, 77 or 78 can be increased after the metal of the blank 38 fills the cavity cv completely. Thus, the flange 76. 77 or 78 can have a large volume, and even when the sleeve portion 74 is formed by backward extrusion and the depression 72 is made deeper so as to go beyond the level corresponding to the backward side surface of the flange 76, 77 or 78, a crack or the like defective opening is never formed at or adjacent the bottom of the depression 72 that corresponds in position to the backward side surface of the flange 76, 77 or 78 or that is located adjacent the same. This is due to the fact that backward movement of the outer punch 65, 65' or 65" causes the plastic flow of the metal into the cavity cv to decrease at the time the inner punch 63 goes beyond the level corresponding to the backward side surface of the flange 76, 77 or 78. Accordingly, the flanged tubular metallic part made of ferrite-system stainless steel that is liable to cause breakage in cold forging can be produced assuredly so as to attain a high productivity.

The entire contents of Japanese Patent Application P2002-118246 (filed Apr. 19, 2002) are incorporated herein by reference.

Although the invention has been described above by reference to certain embodiments of the invention, the invention is not limited to the embodiments described above. Modifications and variations of the embodiment described above will occur to those skilled in the art, in light of the above teachings. For example, the flange can be of any polygonal shape when observed in a plan view, such as square, pentagon, heptagon, nonagon and decagon. Further, while the above-described processes are performed by using a single forging apparatus for forging a metallic part in transfer through a plurality of forging stations each having a punch, counter punch and a die and by a minimum number of processes continuously, they can be performed by using cold forging apparatuses for the respective processes and a trimming apparatus for the trimming process. Further, the flanged tubular metallic part produced according to the method of the present invention is not limited to use in a gas sensor such as the above-described oxygen sensor 10 but can be in other applications such as a housing of a spark plug for engines and holders for various electronic devices. The scope of the invention is defined with reference to the following claims.

What is claimed is:

1. A method of making a flanged tubular metallic part by cold forging, comprising:

a depression forming step of forming an axial depression that is concentric and cylindrical, in a cylindrical blank of ferrite-system stainless steel; and a flange forming step of making the depression axially deeper while causing a metal of the blank to flow radially outward thereby forming the blank into an intermediate product having an annular flange on an outer circumferential surface thereof;

wherein the flange forming step is executed by using a flange forming die assembly including an inner punch, an annular outer punch disposed concentrically around and axially movable relative to the inner punch so as to provide a predetermined space therebetween, a die having a cylindrical hole surrounding the outer punch and a counter punch unit disposed opposite to the inner punch and cooperating with the outer punch and the die so as to define a cavity for forming the flange;

wherein assuming that the direction in which the inner punch is moved for subjecting the blank to the flange forming step is referred to as forward, the flange forming step includes axially moving the inner punch so as to allow a leading end of the inner punch to be position more forward than a backward side surface of the flange thereby causing the intermediate product to be formed with a concentric sleeve portion that is of a predetermined axial length and that is positioned backward of the flange while allowing the outer punch to apply an axial biasing force to the backward side surface of the flange during formation of the flange within the cavity; and wherein the counter punch unit comprises an inner counter punch disposed so as to be concentric with and axially opposed to the inner punch, and an outer counter punch disposed concentrically around and axially movable relative to the inner counter punch so as to axially opposed to the outer punch, and wherein the flange forming step comprises allowing the outer counter punch to apply an axial biasing force to a forward side surface of the flange during formation of the flange.

2. A method according to claim 1, wherein the flange forming step comprises allowing the outer punch to move backward so as to allow the cavity and therefore the flange to increase in volume during formation of the flange.

3. A method according to claim 1, wherein the flange forming step comprises using the outer punch having an end surface that is in abutting engagement with the backward side surface of the flange and that is inclined so that a radially outer surface portion is positioned more forward.

4. A method according to claim 1, wherein the flange forming step comprises using the outer counter punch having an end surface that is in abutting engagement with the forward side surface of the flange and that is inclined so that a radially inner surface portion is positioned more forward.

5. A method according to claim 1, wherein the flange forming step comprises forming an outer periphery of the flange into a polygonal shape when observed axially of the flange.

6. A method according to claim 1, further comprising:

after the flange forming step, a depression finishing step of making the depression of the intermediate product axially further deeper;

a hollow portion forming step of perforating a leading end portion of the intermediate product and thereby forming a hollow portion that extends axially through the intermediate product; and a trimming step of trimming the flange so as to allow an outer periphery of the flange to have a polygonal shape when observed axially of the flange.

7. A method according to claim 1, further comprising a step of heating the blank to a predetermined temperature before the depression forming step.

8. A method according to claim 1, wherein the flange forming step comprises moving the outer counterpunch forward while applying a biasing force to the front side surface of the flange.

9. A method according to claim 1, wherein the flange forming step comprises moving the outer punch backward while applying a biasing force to the backward side surface of the flange.

10. A method of making a flanged tubular metallic part by cold forging, comprising:

a step of preparing a cylindrical blank;

a step of heating the blank to a predetermined temperature;

a depression forming step of forming an axial depression that is concentric and cylindrical, in the blank:

a step of preparing a flange forming die assembly including an inner punch, an annular outer punch disposed concentrically around the inner punch so as to provide a predetermined space therebetween, a die having a cylindrical hole surrounding the outer punch and a counter punch unit disposed opposite to the inner punch and cooperating with the outer punch and the die so as to define an annular cavity for forming an annular flange; and a flange forming step of forming, by using the flange forming die assembly, the blank into an intermediate product having the flange on an outer circumferential surface thereof;

wherein assuming that the direction in which the inner punch is moved for subjecting the blank to the flange forming step is referred to as forward, the flange forming step includes moving the inner punch axially into the depression so as to cause a leading end of the inner punch to be positioned more forward than a backward side surface of the flange thereby causing a metal of the blank to flow radially outward into the cavity to form the flange and axially backward to form, in the space between the inner punch and the outer punch and by backward extrusion, a concentric sleeve portion that is positioned backward of the flange while allowing the outer punch to be yieldingly urged against the backward side surface of the flange during formation of the flange within the cavity; and wherein the counter punch unit comprises an inner counter punch disposed so as to be concentric with and axially opposes to the inner punch, and an outer counter punch disposed concentrically around and axially movable relative to the inner counter punch so as to be axially opposed to the outer punch, and wherein the flange forming step comprises allowing the outer counter punch to apply an axial biasing force to a forward side surface of the flange during formation thereof.

11. A method according to claim 10, wherein the flange forming step comprises allowing the outer punch to move backward so as to allow the cavity and therefore the flange to increase in volume during formation of the flange.

12. A method according to claim 10, wherein the flange forming step comprises using the outer punch having an end surface that is in abutting engagement with the backward side surface of the flange and that is inclined so that a radially outer surface portion is positioned more forward.

13. A method according to claim 10, wherein the flange forming step comprises using the outer counter punch having an end surface that is in abutting engagement with the forward side surface of the flange and that is inclined so that a radially inner surface portion is positioned more forward.

14. A method according to claim 10, wherein the flange forming step comprises forming an outer periphery of the flange into a polygonal shape when observed axially of the flange.

15. A method according to claim 10, further comprising: after the flange forming step, a depression finishing step of making the depression of the intermediate product axially further deeper while allowing the depression to expand radially outward;

a hollow portion forming step of perforating a bottom of the intermediate product and thereby forming a hollow portion that extends axially through the intermediate product; and a trimming step of trimming the flange so as to allow an outer periphery of the flange to have a polygonal shape when observed axially of the flange.

16. A method according to claim 9, wherein the metallic blank is of ferrite-system stainless steel.

17. A method according to claim 10, wherein the flange forming step comprises moving the outer counterpunch forward while applying a biasing force to the front side surface of the flange.

18. A method according to claim 9, wherein the flange forming step comprises moving the outer punch backward while applying a biasing force to the backward side surface of the flange.

* * * * *